US010337352B2

(12) United States Patent
Dubois et al.

(10) Patent No.: US 10,337,352 B2
(45) Date of Patent: Jul. 2, 2019

(54) TURBINE ENGINE CASING AND MANUFACTURING METHOD

(71) Applicant: SNECMA, Paris (FR)

(72) Inventors: Margaux Justine Emma Dubois, Moissy Cramayel (FR); Erwan Pierre Antoine Perse, Moissy Cramayel (FR); Valentine Bader, Moissy Cramayel (FR); Jean-Pierre Trzebski, Moissy Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 14/907,788

(22) PCT Filed: Jul. 25, 2014

(86) PCT No.: PCT/FR2014/051935

§ 371 (c)(1),
(2) Date: Jan. 26, 2016

(87) PCT Pub. No.: WO2015/015101

PCT Pub. Date: Feb. 5, 2015

(65) Prior Publication Data

US 2016/0169045 A1 Jun. 16, 2016

(30) Foreign Application Priority Data

Jul. 29, 2013 (FR) ..... 13 57487

(51) Int. Cl.
*F01D 25/24* (2006.01)

(52) U.S. Cl.
CPC ..... *F01D 25/243* (2013.01); *F05D 2220/30* (2013.01); *F05D 2230/10* (2013.01);
(Continued)

(58) Field of Classification Search
CPC ..... F01D 25/243; F01D 25/246; F01D 9/04; F02C 7/20
See application file for complete search history.

(56) References Cited

U.S. PATENT DOCUMENTS 1,061,675 A * 5/1913 Junggren ..... F01D 9/042 415/189
3,303,998 A * 2/1967 Koff ..... F01D 9/042 415/209.1

(Continued)

FOREIGN PATENT DOCUMENTS

DE 102006002121 A1 * 8/2006 ..... F01D 25/243
FR 2925120 A1 6/2009
FR 2978495 A1 2/2013

OTHER PUBLICATIONS

International Search Report and Written Opinion of the International Searching Authority for International Application No. PCT/FR2014/051935.

*Primary Examiner* — Justin D Seabe
(74) *Attorney, Agent, or Firm* — Womble Bond Dickinson (US) LLP

(57) ABSTRACT

The invention relates to a method for manufacturing a turbine engine casing (1), characterized in that said method includes the steps of: manufacturing (E1) a plurality of sectors (2), at least one portion of the sectors (2) being manufactured by casting and including, on the surface thereof, fastening elements (3) produced during the casting step, assembly bands (8) being produced at the ends of the sectors (2) during the step of manufacturing the sectors (2) by casting, by means of which the sectors (2) can be assembled; and assembling (E2) the sectors (2) end-to-end such as to form a ring (5) of the casing (1). The invention also relates to a turbine engine casing (1).

28 Claims, 4 Drawing Sheets

(52) U.S. Cl.
CPC .... *F05D 2230/21* (2013.01); *F05D 2230/232* (2013.01); *F05D 2230/60* (2013.01); *F05D 2300/133* (2013.01)

(56) References Cited

U.S. PATENT DOCUMENTS

| | | | | | |
|---|---|---|---|---|---|
| 4,208,774 | A * | 6/1980 | Voyer | F01D 25/243 | 219/121.35 |
| 5,516,257 | A * | 5/1996 | Kasprow | F01D 21/045 | 415/200 |
| 6,439,842 | B1 * | 8/2002 | Toomey | F01D 11/08 | 415/162 |
| 9,127,568 | B2 * | 9/2015 | Wilson | F01D 25/243 | |
| 2009/0047126 | A1 * | 2/2009 | Ress, Jr. | F01D 9/041 | 415/209.3 |
| 2011/0073745 | A1 * | 3/2011 | Duchatelle | F01D 9/04 | 248/637 |
| 2011/0268566 | A1 * | 11/2011 | Ferrer | B21C 37/154 | 415/200 |
| 2011/0274541 | A1 * | 11/2011 | Belmonte | F01D 5/066 | 415/213.1 |
| 2012/0039716 | A1 * | 2/2012 | Ahmad | F01D 9/023 | 416/198 A |
| 2013/0259664 | A1 * | 10/2013 | Denis | B23K 31/02 | 415/182.1 |
| 2014/0373556 | A1 * | 12/2014 | Aronsson | F01D 25/162 | 60/796 |

* cited by examiner

TURBINE ENGINE CASING AND MANUFACTURING METHOD

FIELD OF THE INVENTION

The invention concerns a turbine engine casing and a method for manufacturing a turbine engine casing.

OVERVIEW OF THE PRIOR ART

FIG. 1 shows an upstream part of a turbine engine comprising a fan 100, surrounded by a fan casing 101. The fan 100 casing is extended by an intermediate casing 102 comprising a ring 103 or ferrule.

The ring 103 of the intermediate casing 102 comprises a plurality of fastening elements, which allow the fastening of turbine engine members to the casing 102, such as the accessory drive module (or ADM.)

Such an intermediate casing is for example described in the patent FR2925120 or in the patent application FR1262269.

The intermediate casing 102 is conventionally manufactured by machining into the body of a raw bulk of aluminum, steel or titanium. The members to be assembled are subsequently added to the part formed by machining the bulk.

This solution has several drawbacks.

It involves complex machining steps, which leads to an increase in manufacturing costs.

Furthermore, it is necessary to add the fastening elements to the part, which makes the part heavier due to the weight of the additional washers, screws and flanges that make the assembly possible.

PRESENTATION OF THE INVENTION

To improve the existing solutions, the invention proposes a method for manufacturing a turbine engine casing, characterized in that it comprises the steps consisting in:

- manufacturing a plurality of sectors, at least a part of the sectors being manufactured by casting and comprising on their surface attaching elements obtained in the casting step, and
- assembling the sectors end-to-end so as to form a ring of the casing.

The invention is advantageously completed by the following features, taken alone or in any one of their technically possible combinations:

- in the step of manufacturing the sectors by casting, assembling strips are obtained at the ends of the sectors, via which the sectors can be assembled, and/or attaching elements;
- the method comprises the step consisting in machining the outer face of the assembling strips before assembling the sectors;
- the method comprises the step consisting in assembling the sectors by welding or bolting;
- the method comprises the step consisting in, after assembling the sectors:
  - machining the sectors, so as to form additional fastening elements on the surface of the sectors, and/or machining, at least partly, the assembling strips.

The invention further concerns a turbine engine casing, characterized in that it comprises a ring composed of an assembly of a plurality of sectors, at least a part of the sectors being manufactured in a single piece with attaching elements on their surface by a casting method.

According to an embodiment, the sectors are made of titanium.

According to an embodiment, the sectors comprise assembling strips at their ends, via which the sectors are assembled.

In particular, the assembling strips have a constant width, and/or the assembling strips have a height, the profile of which follows the variation of the thickness profile of the ends of the sectors.

Finally, the invention concerns a turbine engine comprising a fan and a casing as described previously.

The invention has many advantages.

The manufacturing of the sectors by casting makes it possible to incorporate the attaching elements as from the manufacturing stage, which avoids subsequent steps of joining on and bolting additional parts. The associated weight and costs are thus reduced.

The solution reduces the number and complexity of the machining steps required for the manufacturing of the casing.

In addition the solution offers a good compromise between the weight of the casing and the manufacturing costs.

Furthermore, the casing comprising a plurality of sectors of smaller size than the casing itself, the manufacturing operations can thus be carried out by a greater number of smelters.

The modest size of the sectors thus makes it possible to improve the casting form tolerance.

Finally, the solution is applicable even to casings of large dimensions, the casing being subdivided into several sectors of smaller dimensions.

PRESENTATION OF THE FIGURES

Other features and advantages of the invention will yet become apparent from the following description, which is purely illustrative and non-limiting, and must be read with reference to the appended drawings wherein.

DETAILED DESCRIPTION

The figures depict the different steps and elements for manufacturing a turbine engine casing 1.

Figure 1:
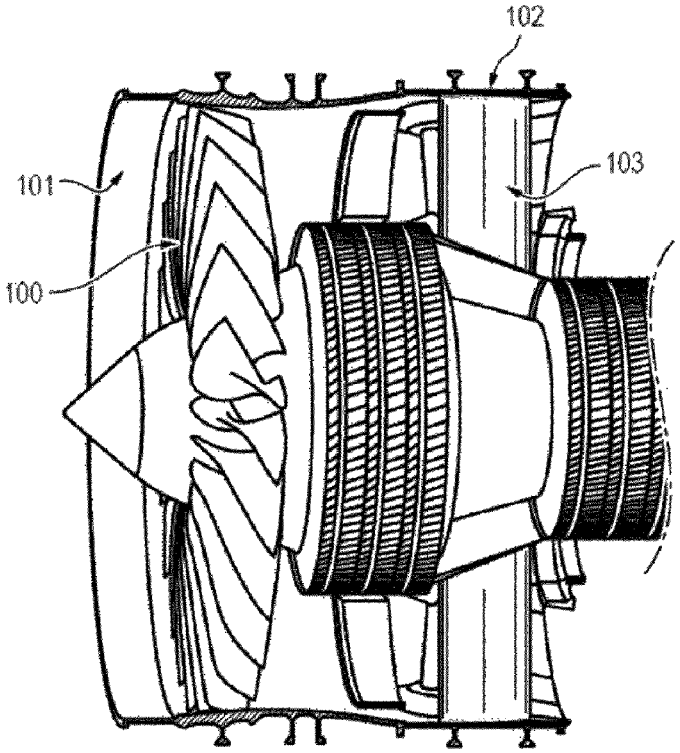
FIG. 1 is a part view of a turbine engine.

This can for example be the so-called intermediate casing 1 which is juxtaposed on the fan casing in the turbine engine, as already illustrated in FIG. 1. The solution also applies to the other casings of the turbine engine (fan casing etc.)

Figure 3:
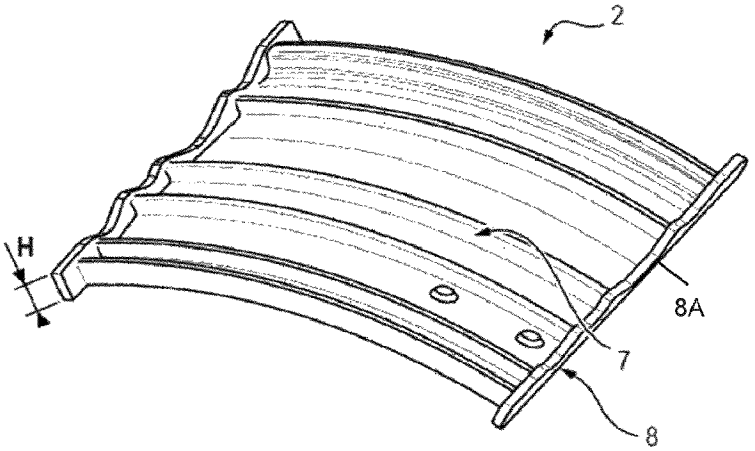
FIG. 3 is a depiction of another type of sector of the casing.
Figure 2:
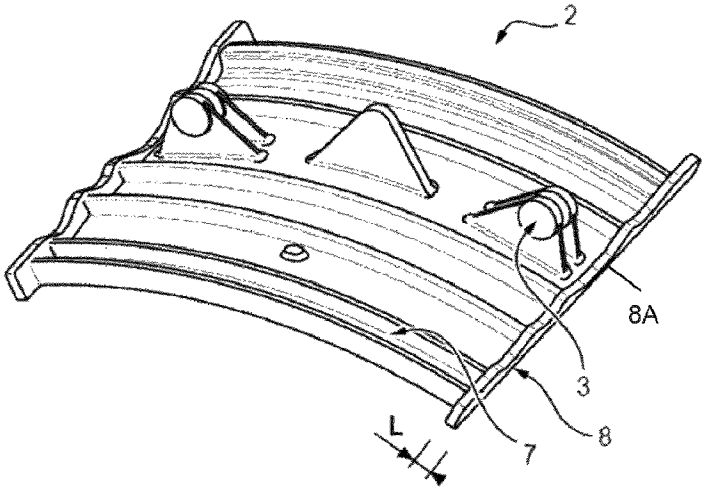
FIG. 2 is a depiction of a sector of the casing of the type equipped with fastening clevises.

A plurality of sectors 2, such as those illustrated in FIGS. 2 and 3, are manufactured by casting (step E1—method for shaping metals which consists in pouring a liquid metal into a mold to replicate a given part after cooling).

The sectors 2 comprise attaching elements 3 on their surface. These attaching elements 3 notably comprise bosses or clevises for fastening axes, flanges, arms, or any mechanical part of the turbine engine connected to the casing 1. The attaching elements 3 are manufactured in the casting step.

Thanks to the casting process, the sectors 2 are manufactured in a single piece with the attaching elements 3 on their surface, which avoids the steps of bolting and joining on additional parts.

Conventionally, the sectors 2 comprise ribs 7 acting as stiffeners of the structure. These ribs 7 are also manufactured in the casting step.

After manufacturing the sectors 2 by casting, they are assembled end-to-end so as to form a ring 5 of the casing 1.

The assembly of the sectors 2 can for example be carried out by welding. Other assembly operations are possible, such bolting sectors 2 together, for example.

In a variant, the assembly comprises a hot forming operation for improving the circularity of the ring 5 of the casing 1.

In a variant embodiment, a part of the sectors 2 to be assembled is manufactured using a different manufacturing method, such as rolling, particularly of circular type.

The manufacturing of the sectors 2 can comprise obtaining assembling strips 8 at the ends of the sectors 2, via which the sectors 2 are assembled. These strips 8 are obtained by incorporation via casting or by being made as a single part with the sectors 2.

These assembling strips 8 are manufactured in the casting step. Consequently, these are also of a single piece with the sectors 2, and do not require the joining on of additional parts.

These assembling strips 8, present at the ends of the sectors 2 having a raw casting outer face 8*a* requiring machining. Machining of the raw outer face 8*a* of the strips 8 (step E2) is performed before assembling the sectors.

The strips 8 notably facilitate the operations of welding or bolting the sectors 2 together, and reducing the variations in thickness at the ends of the sectors 2.

Different shapes of assembling strip 8 can be used. A simple shape is that of a parallelepiped.

According to an exemplary embodiment, the assembling strips 8 have a constant width L. The width is the dimension of the assembly strip 8 along the axis tangential to the ring 5 formed by the sectors 2 (see FIG. 2).

This choice of a constant width L allows for better diffusion of the welding energy, or a sufficient distribution of material for bolting forces uniformly distributed and use of identical screws.

The height H of the assembling strips 8 can be constant or variable.

It is preferable that the height H has a variation, the amplitude of which is limited (in particular, sudden variations, of stair step type, are to be avoided), in order to facilitate the welding of the strips 8 together.

According to an exemplary embodiment, the height H has a profile that follows the variation of the thickness profile of the ends of the sectors 2.

The profile of the height H is not strictly identical to the profile of the thicknesses of the ends of the sectors 2, in order to avoid having variations in stair step shape, but follows the general shape of it.

This is notably visible in FIGS. 2 and 3, where it can be seen that the profile of the height H has minima and maxima at the same places as the profile of the thickness of the ends of the sectors 2.

The sectors 2 are angular sectors, the angular extent of which varies according to various criteria such as the desired number of sectors of the ring, the diameter of the casing to be manufactured, the manufacturing tolerances of the casting operation, and the position of the attaching elements 3 on the sectors 2.

The ring 5 comprises at least two sectors 2, but can also comprise a higher number of sectors 2 (for example, in the case of a ring of a diameter equal to 2 m, ten or so sectors of a cord of 600 mm approximately).

The angular extent of the sectors 2 is chosen such that the assembling strips 8 located at their ends are not in contact with the attaching elements 3 of the sectors 2.

Furthermore, it is desirable to dispose as many sectors 2 with a same angular extent as possible, in order to reduce the number of different raw bulks required for their manufacturing, and thus the manufacturing costs.

Figure 4B:
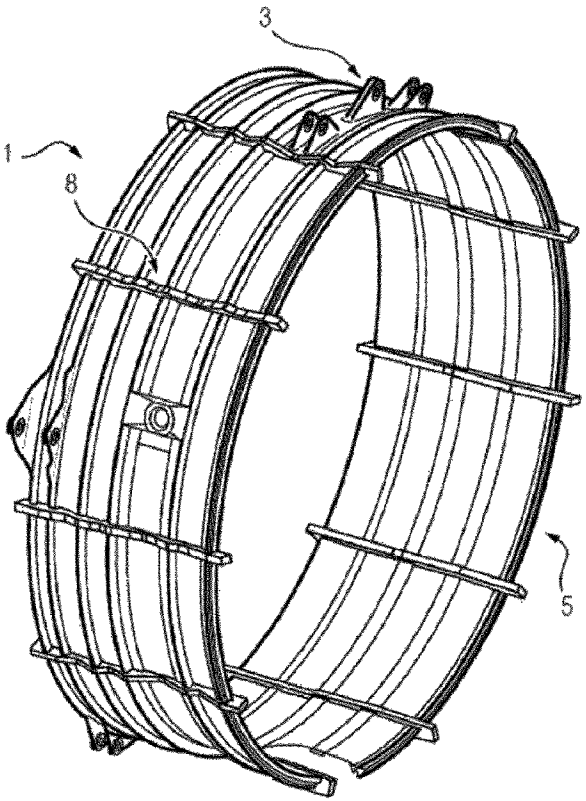
FIGS. 4A and 4B are a depiction of the assembly of the sectors of the casing.
Figure 4A:
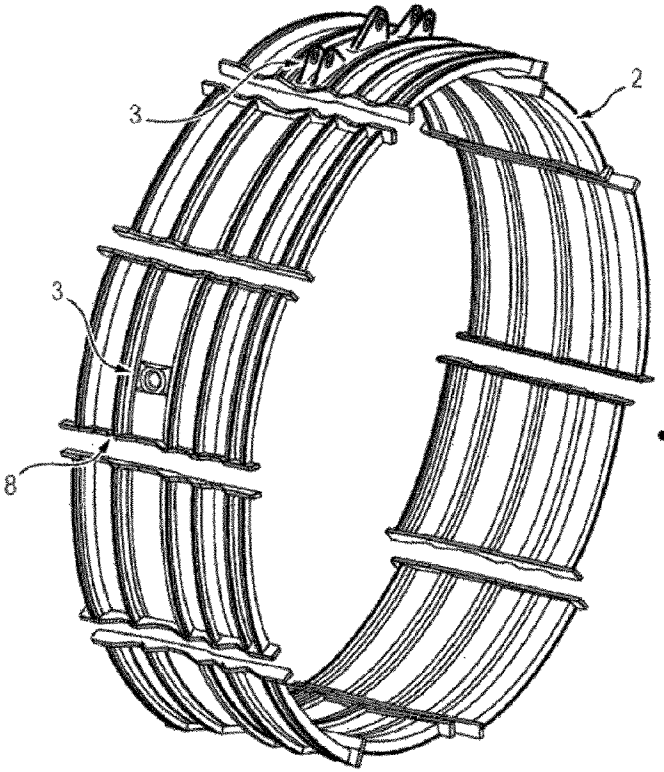
Figure 6:
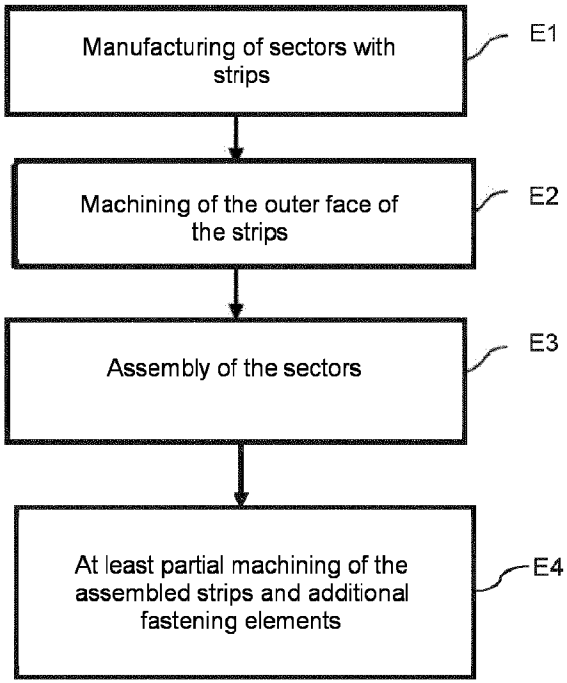
FIG. 6 is a schematic depiction of a method for manufacturing the casing.
Figure 5:
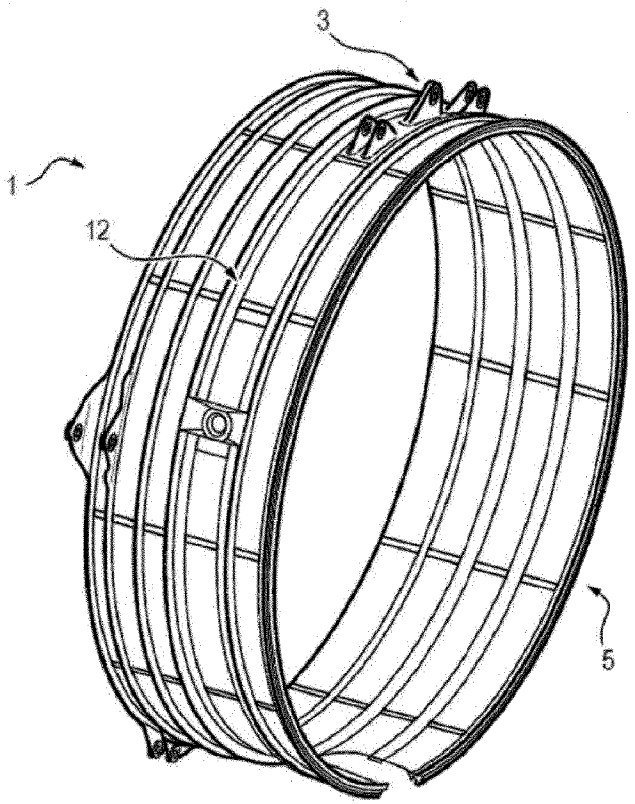
FIG. 5 is a depiction of the casing after a further machining step.

After assembly (step E3) of the sectors 2 via their assembling strips 8, the strips 8 can be, at least partly, machined (step E4). This machining makes it possible to reduce the thickness of the strips 8 to a strict minimum, in order to reduce the weight of the casing 1. Advantageously, the strips 8 are removed by machining (see FIG. 5 wherein the strips 8 have been machined after the assembly effected in FIG. 4B).

Furthermore, the sectors 2 are machined after their assembly so as to form additional fastening elements 12 on the surface of the sectors 2.

These additional elements 12 are for example elements, the manufacturing tolerances of which are narrow and cannot be achieved in the casting step. This is the case, for example, of openings worked in the ribs 7 of the sectors 2.

According to an embodiment, the sectors 2 are made of titanium. Titanium is known for its good mechanical resistance and its good fire resistance. It becomes possible to significantly reduce the thicknesses of flanges or bodies.

This choice of material thus reduces the weight of the casing 1 compared to other known materials, such as aluminum, the use of the latter being less suitable given its lesser mechanical and fire resistance.

Furthermore, the manufacturing of the casing 1 by way of an assembly of a plurality of sectors 2 resulting from a casting method makes it possible to reduce the material needed for the raw bulks, particularly as regards solutions involving machining into the body of a single bulk. Indeed, the ratio of the material of the final part to the material of the raw bulk is clearly more advantageous in this solution than in a machining into the mass of a single bulk.

Consequently, although titanium has a greater cost than aluminum and poses machinability problems, the cost generated by the choice of titanium as the raw bulk material is low, aluminum also posing molding problems in casting operations.

The manufacturing of the sectors 2 by casting also makes it possible to incorporate the attaching elements 3 on the surface of the sectors 2 from the manufacturing stage of the sectors, which avoids subsequent steps of joining and bolting additional parts. The associated weight and costs are thus reduced.

The pre-forming of the sectors 2 by casting further reduces the number and complexity of the machining steps, which further reduces the associated costs.

The solution applies to any turbine engine casing. It is particularly applicable to the intermediate casing of the turbine engine, downstream of the fan casing along the flow direction of the stream.

It is advantageously, but not limitingly, applicable to casings of large dimensions, i.e. with a diameter greater than 1.50 meters.

The invention claimed is:

1. A method for manufacturing a turbine engine casing, comprising the steps of:

manufacturing a plurality of angular sectors to be assembled to form a ring, said sectors comprising assembling strips arranged at their angular ends via which the sectors can be assembled, said strips extending all along said angular ends with a radial outer face parallel to the axis of the ring, at least some of the sectors being manufactured by casting and comprising on their surface attaching elements obtained in the casting step, a profile of a height of the assembling strips having minima and maxima at the same places as a profile of a thickness of the angular ends of the angular sectors, the length of the assembling strip along the axis of the ring being greater than the length of the angular ends of the angular sectors along the axis of the ring, machining the outer face of the assembling strips and assembling the sectors end-to-end so as to form a ring of the casing, the sectors being assembled by welding of the strips.

2. The method according to claim 1, comprising the step of, after assembling the sectors:

machining the sectors, so as to form additional fastening elements on the surface of the sectors, and/or machining, at least partly, the assembling strips.

3. The method according to claim 1 comprising the step consisting in hot forming of the ring.

4. The method according to claim 1 wherein the manufacturing step includes the titanium casting of the angular sectors.

5. The method according to claim 1 wherein the assembling strips, produced in the manufacturing step, have a constant width (L).

6. A turbine engine casing, comprising a ring composed of an assembly of a plurality of angular sectors, at least some of the sectors being manufactured from a single piece with attaching elements on their surface by a casting method, the sectors comprising at their angular ends assembling strips, said strips extending all along said angular ends with a radial outer face parallel to the axis of the ring, a profile of a height of the assembling strips having minima and maxima at the same places as a profile of a thickness of the angular ends of the angular sectors, the length of the assembling strip along the axis of the ring.

7. The method according to claim 1, comprising the step, after assembling the sectors, removing the strips by machining.

8. The method according to claim 1 wherein the attaching elements comprise bosses, devises for fastening axes, flanges or arms.

9. The method according to claim 1 wherein the sectors comprise at least one rib.

10. The method according to claim 1 wherein a part of the sectors is manufactured using a rolling method.

11. The method according to claim 1 wherein a part of the sectors is manufactured using a rolling method of circular type.

12. The method according to claim 1 wherein the at least two angular sectors have the same angular extent.

13. The method according to claim 9 comprising the step, after assembling the sectors, at least one opening is manufactured in the ribs of the angular sectors.

14. The method according to claim 1 wherein the casing has a diameter greater than 1.50 meters.

15. The method according to claim 1, comprising the step of, after assembling the sectors, machining the assembling strips so as to reduce the length of the assembling strip along the axis of the ring being to the length of the angular ends of the angular sectors along the axis of the ring.

16. The method according to claim 1, in which before machining the outer face of the assembling strips, the height of the assembling strip is superior to the thickness of the angular ends of the angular sectors.

17. The casing according to claim 6, wherein fastening elements on the surface of the sectors are machined.

18. The casing according to claim 6, wherein the sectors are made of titanium.

19. The casing according to claim 6, wherein:

the assembling strips have a constant width (L).

20. The casing according to claim 6 wherein the attaching elements comprise at least one of bosses, devises for fastening axes, flanges and arms.

21. The casing according to claim 6 wherein the angular sectors comprise at least one rib.

22. The casing according to claim 6 wherein a part of the angular sectors is manufactured using a rolling method.

23. The casing according to claim 6 wherein a part of the angular sectors is manufactured using a rolling method of circular type.

24. The casing according to claim 6 wherein the at least two angular sectors have the same angular extent.

25. The casing according to claim 21 wherein the angular sectors comprise at least one manufactured rib.

26. The casing according to claim 6 wherein the casing has a diameter greater than 1.50 meters.

27. A turbine engine comprising a fan and a casing according to claim 6.

28. A method for manufacturing a turbine engine casing, comprising the steps of:

manufacturing a plurality of angular sectors to be assembled to form a ring, said sectors comprising assembling strips arranged at their angular ends via which the sectors can be assembled, said strips extending all along said angular ends with a radial outer face parallel to the axis of the ring, at least some of the sectors being manufactured by casting and comprising on their surface attaching elements obtained in the casting step, a profile of a height of the assembling strips having minima and maxima at the same places as a profile of a thickness of the angular ends of the angular sectors, the length of the assembling strip along the axis of the ring being greater than the length of the angular ends of the angular sectors along the axis of the ring machining the outer face of the assembling strips and assembling the sectors end-to-end so as to form a ring of the casing, the sectors being assembled by welding of the strips, machining, at least partly, the assembling strips.

* * * * *